US007980440B2

(12) United States Patent
Hahn et al.

(10) Patent No.: US 7,980,440 B2
(45) Date of Patent: Jul. 19, 2011

(54) COMBUSTION-ENGINED SETTING TOOL

(75) Inventors: Christian Hahn, Uebersaxen (AT); Rolf Erhardt, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 69 days.

(21) Appl. No.: 12/384,194

(22) Filed: Mar. 31, 2009

(65) Prior Publication Data

US 2009/0250499 A1 Oct. 8, 2009

(30) Foreign Application Priority Data

Apr. 1, 2008 (DE) ..... 10 2008 000 909

(51) Int. Cl.
*B25C 1/12* (2006.01)

(52) U.S. Cl. ..... 227/10; 227/120; 227/130; 173/11; 123/46 SC

(58) Field of Classification Search ..... 227/9, 10, 227/156, 119, 120, 130, 133; 173/2, 6, 9, 173/11; 123/46 SC
See application file for complete search history.

(56) References Cited

U.S. PATENT DOCUMENTS

| | | | | |
|---|---|---|---|---|
| 4,365,471 | A * | 12/1982 | Adams | 60/39.76 |
| 4,712,379 | A * | 12/1987 | Adams et al. | 60/632 |
| 6,016,945 | A * | 1/2000 | Phillips et al. | 227/10 |
| 6,145,724 | A * | 11/2000 | Shkolnikov et al. | 227/8 |
| 6,260,519 | B1 * | 7/2001 | Phillips | 123/46 R |
| 7,004,366 | B2 * | 2/2006 | Schiestl et al. | 227/8 |
| 7,073,698 | B2 * | 7/2006 | Frommelt et al. | 227/10 |
| 7,118,018 | B2 * | 10/2006 | Turk | 227/10 |
| 7,284,511 | B2 * | 10/2007 | Zahner et al. | 123/46 H |
| 7,497,271 | B2 * | 3/2009 | Moeller et al. | 173/1 |
| 7,571,841 | B2 * | 8/2009 | Gibson et al. | 227/10 |
| 2004/0182907 | A1 * | 9/2004 | Dittrich | 227/10 |
| 2006/0266785 | A1 * | 11/2006 | Moeller et al. | 227/8 |
| 2008/0011251 | A1 * | 1/2008 | Tanaka | 123/46 SC |

* cited by examiner

*Primary Examiner* — Paul Durand
(74) *Attorney, Agent, or Firm* — Abelman, Frayne & Schwab

(57) ABSTRACT

A combustion-engined setting tool (10) for driving fastening elements in a workpiece includes a combustion chamber (11), a drive piston (15) displaceable in a piston guide (17) and driven by expanding gases produced in the combustion chamber (11), and a device for returning the drive piston (15) in its initial position as a result of pressure difference between chambers formed on opposite axial sides of the piston head (115), and including a pump (20).

11 Claims, 1 Drawing Sheet

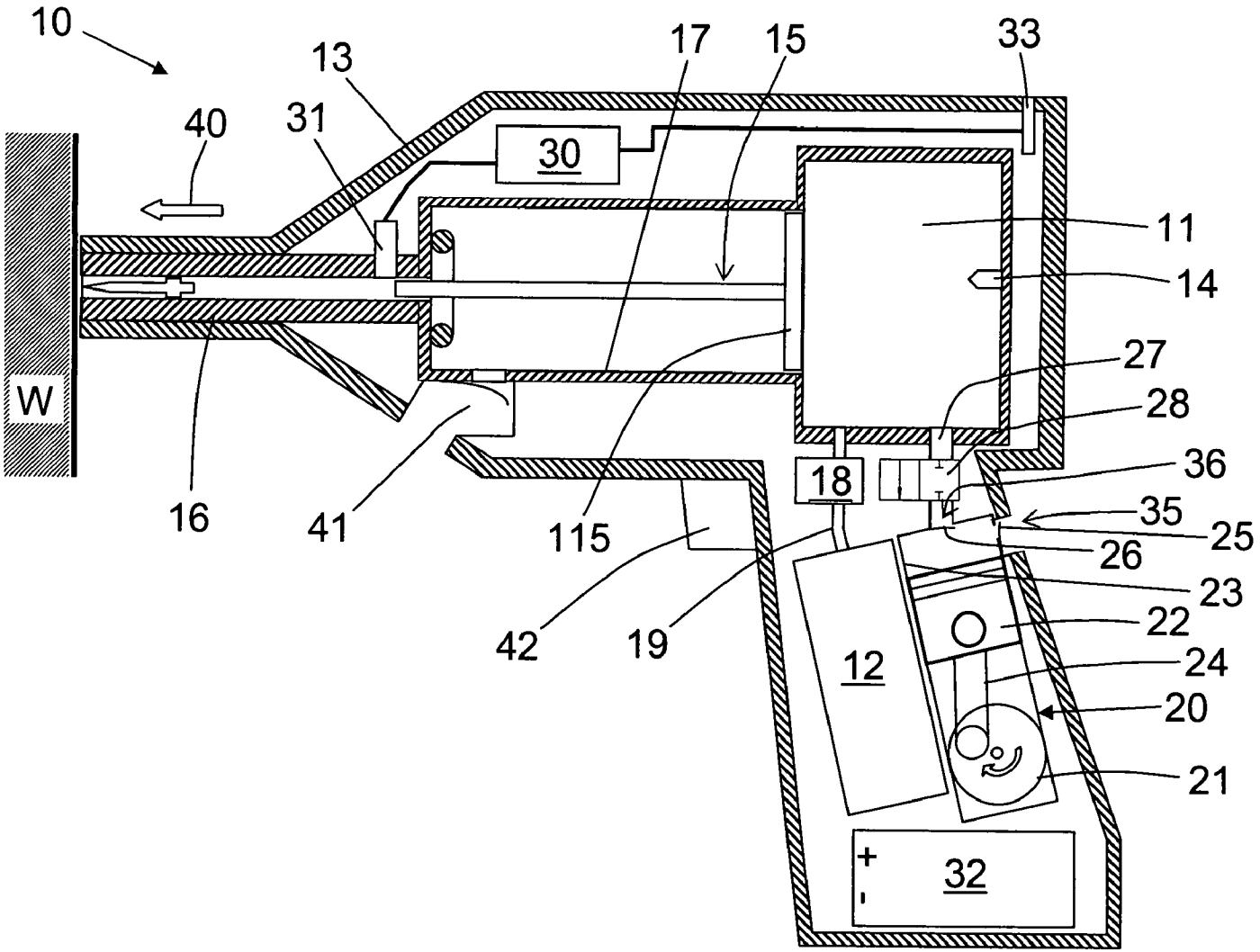
10
11
12
13
14
15
16
17
18
19
20
21
22
23
24
25
26
27
28
30
31
32
33
35
36
40
41
42
115
W
+
-

COMBUSTION-ENGINED SETTING TOOL

BACKGROUND OF THE INVENTION

1. Field of the Invention

The present invention relates to a combustion-engined setting tool for driving fastening elements in a workpiece and including a combustion chamber for fuel, a piston guide, a drive piston displaceable in the piston guide, having a piston head and driven by expanding gases produced in the combustion chamber, and a device for returning the drive piston in its initial position as a result of pressure difference between chambers formed on opposite axial sides of the piston head.

2. Description of the Prior Art

Setting tools of the types described above can operate on gaseous or evaporated liquid fuels which are combusted in a combustion chamber and thereby drive a drive piston for driving fastening elements. After completion of a setting process, the drive piston should be returned to its initial position adjacent to the combustion chamber, so that the setting tool is ready for a next setting process.

German Publication DE 195 09 763 A1 discloses a combustion-engined setting tool having a drive piston displaceable in a piston guide and driven by propellant gases and which drives a fastening element in a constructional component with the piston shaft. The return of the drive piston in its initial position is effected by an elastomeric compression or tension spring.

The drawback of the setting tool disclosed in the German publication consists in that the drive piston at a certain state of wear does not return completely in its initial position, which leads to reduction of the available setting energy. On the other hand, particles of the elastomeric spring can become loose, interfering with the setting tool functions.

European Publication EP 0 056 989 A1 discloses a further combustion-engined tool with a piston displaceable in a piston guide and in which the drive piston is returned to its initial position by a pressure difference (or a differential pressure) between the environmental pressure that acts on the side of the drive piston remote from the combustion chamber, and the pressure created in the combustion chamber.

The drawback of the tool disclosed in the European Publication consists in that a faulty position of the piston can occur when, e.g., the friction of the drive piston increases as a result of contamination, and the piston does not return completely in its initial position, or when as a result of a too small difference between the environmental temperature and the power tool temperature, the pressure difference is not sufficient for a complete return of the drive piston in its initial position.

Accordingly, an object of the present invention is a setting tool in which a low-wear and reliable return of the drive piston in is initial position is possible.

SUMMARY OF THE INVENTION

This and other objects of the present invention, which will become apparent hereinafter, are achieved by providing a setting tool in which the returning device includes a pump. The pump produces a differential pressure for returning of the drive piston or at least reinforces the differential pressure. The provision of the pump insures always a complete return of the drive piston in its initial position. On the other hand, a high setting frequency can be achieved as a result of a more rapid return of the drive piston in its initial position. The pump can be a single source for producing the differential pressure, or can reinforce a thermally produced differential pressure.

Advantageously, the pump is formed as an electrical suction pump for producing a suction air flow and is connected with the combustion chamber. The pump produces underpressure in the combustion chamber, so that environmental pressure, which acts on a side of the drive piston remote from the combustion chamber, can return the drive piston to its initial position.

It is further advantageous when there is provided a control unit for controlling the pump based on data produced by sensors. This insures an efficient operation of the pump and energy saving.

Advantageously, the sensors include a piston sensor that detects the position of the drive piston, so that the control unit can turn the pump off after the drive piston has been returned in its initial position.

It is further advantageous when the sensors includes a temperature sensor, so that the control unit actuates the pump only when the temperature difference between the tool temperature or the combustion chamber temperature and the environmental temperature is below a certain value. This insures a complete return of the drive piston in its initial position. This also permits to achieve a high energy efficiency of the piston returning device.

It is also advantageous when an electrically controlled check valve is provided between the pump and the combustion chamber and which is controlled by the controlled unit. The check valve is closed by the control unit when the drive piston is returned in its initial position. This insures that pressure waves, which are produced in the combustion chamber during a setting process, do not reach the pump and damage it. Further, at the end of a setting process which is detected, e.g., by the piston sensor or is determined by time-control-means, the control unit can open the check valve, connecting the pump and the combustion chamber. Thereby, gases are aspirated from the combustion chamber, producing vacuum therein.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

In the Drawings:

Single FIGURE shows a cross-sectional view of a setting tool according to the present invention.

DETAILED DESCRIPTION OF THE PREFERRED EMBODIMENT

A setting tool 10 according to the present invention, which is shown in the drawing, can be operated with a fuel gas or an evaporated liquid fuel and includes a housing 13 and a setting mechanism located in the housing. The setting mechanism drives a fastening element such as nail, bolt, etc. in a workpiece W when the setting tool 10 is pressed with its bolt guide 16 against the workpiece and is actuated. For actuation of the setting tool 10, there is provided, in addition to a safety switch in form of a contact switch, a trigger switch 42. The trigger switch 42 is located on a handle of the setting tool 10.

The setting mechanism includes, among others, a combustion chamber 11, a piston guide 17 in which a drive piston 15 is displaceably supported, and the bolt guide 16 in which a fastening element can be displaced. The fastening element can be driven in a workpiece with a forward-movable, setting direction-side, end of the drive piston 15. The bolt guide 16 adjoins, in the setting direction, the piston guide 17. The drive piston 15 has, at its end adjacent to the combustion chamber 11, a piston head 115 formed as a piston plate sealingly engaging the inner wall of the piston guide 17 upon displacement of the drive piston 15, and separating, in the axial direction defined by the drive piston 15, a first chamber and a second chamber from each other.

In the embodiment shown in the drawing, an ignition device 14 such as, e.g., a spark plug, is located in the combustion chamber 14 for igniting an oxidant-fuel mixture fed into the combustion chamber 11 for effecting a setting process. Feeding of the fuel into the combustion chamber 14 takes place from a fuel reservoir 12 or a fuel source through a fuel conduit 19. In the embodiment shown in the drawing, a metering device 18, e.g., a mechanical or electronic metering valve, is located in the fuel conduit 19. A mechanical or electronic control device, not shown in the drawing, can regulate, via the metering device 18, feeding of fuel to the combustion chamber 11. During a setting process, the trigger switch 42 actuates the ignition device 14 that ignites the air-fuel mixture in the combustion chamber 11. The expanding gases drive the drive piston 15 in the setting direction 40, i.e., in the direction of the bolt guide 16. The air in the first chamber between the piston head 115 and an end of the piston guide 17 which adjoins the bolt guide 16, which is displaced by the drive piston 15, can be exhausted through the exhaust 41. The expanding combustion gases can likewise be evacuated from the combustion chamber 11 through the exhaust 42 as soon as the piston head 115 passes past the exhaust opening, whereby the exhaust opening becomes connected with the second chamber between the piston head 115 and the combustion chamber 11. After the combustion gases have been evacuated and after the exhaust has been closed, as a result of cooling of the combustion chamber 11, a differential pressure is produced between the first chamber on the side of the piston head 115 remote from the combustion chamber 11, and the second chamber on the side of the piston head 115 adjacent to the combustion chamber 11.

The setting tool 10 further includes a pump 20 of the device for returning the drive piston 15. The pump 20 is formed, e.g., as a suction pump and includes a piston 22 driven by an electrical drive 21 and displaceable in a cylinder 23. A connection rod 24 mechanically connects the piston 22 with the electrical drive 23. The electrical energy for an electrical drive 21 is supplied from an electrical energy source 32 available in the setting tool 10. The electrical energy source 32 can be, e.g., in form of an accumulator or a batter. A conduit 27 communicates the pump 20 with the combustion chamber 11. In the conduit 27, there is arranged a check valve 28 that is electrically controlled by a control unit 30 which also controls the operation of the pump 20. The check valve 28 closes the conduit 27 in its locking position shown in the drawings, and provides for a pneumatic communication between the combustion chamber 11 and the pump 20 in the open position of the check valve 28.

The cylinder 23 of the pump 20 has an inlet 36 in which a conduit 27 opens, and an outlet 35 open toward the environment and through which gases aspirated from the combustion chamber 11 are released into the environment. At the inlet 36, there is arranged a valve 26 that enables entry of gases in the cylinder 23. The valve 26 blocks the flow of air in an opposite direction from the cylinder 23 into the combustion chamber 11. At the outlet 35, there is provided a valve 25 that enables the flow of gases or air from the cylinder 23 and block the flow of environmental air into the cylinder 23.

The control unit 30 is connected with a plurality of sensors at least one of which is a piston sensor 31 for determining the piston position. Preferably, the plurality of sensors includes also at least one temperature sensor 33 for determining a temperature difference between the power tool or combustion chamber temperature and the environmental temperature. Based on measurement data communicated by the piston sensor 31 and the temperature sensor 33, the control unit 30 controls both the pump 20 and the check valve 28. The control unit 30 actuates the pump 20 when the environmental temperature communicated by the temperature sensor 33 is so high that the temperature difference between the environmental temperature and the combustion chamber temperature falls short of a predetermined threshold, and the piston sensor 31 determines that the drive piston 15 is not in its initial position. Then, the control unit 30 displaces the check valve 28 to its open position, enabling communication between the pump 20 and the combustion chamber 11. The pump 20 produces a suction flow from the combustion chamber 11, increasing the pressure difference between the two chambers on opposite axial sides of the piston head 115. Thereby, the drive piston 15 is referenced to its initial position. The drive piston is quasi "aspirated" to the combustion chamber 11. As soon as the piston sensor 31 communicates a signal that the drive piston 15 is again in its initial position, the control unit 30 turns off the pump 20 and displaces the check valve 28 in its locking position (see the drawing figure).

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool (10) for driving fastening elements in a workpiece, comprising:

a combustion chamber (11) for fuel;

a piston guide (17);

a drive piston (15) displaceable in the piston guide (17), having a piston head (115) and driven by expanding gases produced in the combustion chamber (11); and a device for returning the drive piston (15) in an initial position thereof as a result of pressure difference between chambers formed on opposite axial sides of the piston head (115), the returning device including a pump (20), wherein the pump (20) is formed as an electrical suction pump for producing a suction air flow and is connected with the combustion chamber (11).

2. A setting tool according to claim 1, comprising a control unit (30) for controlling the pump (20) based on data produced by sensor means.

3. A setting tool according to claim 2, wherein the sensor means comprises a piston sensor (31) for detecting a position of the drive piston (15).

4. A setting tool according to claim 3, wherein the sensor means comprises a temperature sensor (33).

5. A setting tool according to claim 4, comprising an electrically controlled check valve (28) provided between the pump (20) and the combustion chamber (11) and controlled by the control unit (30).

6. A setting tool according to claim 3, comprising an electrically controlled check valve (28) provided between the pump (20) and the combustion chamber (11) and controlled by the control unit (30).

7. A setting tool according to claim 2, comprising an electrically controlled check valve (28) provided between the pump (20) and the combustion chamber (11) and controlled by the control unit (30).

8. A setting tool according to claim 2, wherein the sensor means comprises a temperature sensor (33).

9. A combustion-engined setting tool (10) for driving fastening elements in a workpiece, comprising:

a combustion chamber (11) for fuel;

a piston guide (17);

a drive piston (15) displaceable in the piston guide (17), having a piston head (115) and driven by expanding gases produced in the combustion chamber (11); and a device for returning the drive piston (15) in an initial position thereof as a result of pressure difference between chambers formed on opposite axial sides of the piston head (115), the returning device including a pump (20) for producing a differential pressure between the chambers on the opposite axial sides of the piston head (115), a control unit (30) for controlling the pump (20) based on operational data produced by sensor means, and an electrically controlled check valve (28) provided between the pump (20) and the combustion chamber (11) and controlled by the control unit (30).

10. A setting tool according to claim 9, wherein the sensor means comprises a piston sensor (31) for detecting a position of the drive piston (15).

11. A setting tool according to claim 9, wherein the sensor means comprises a temperature sensor (33).

* * * * *